United States Patent [19]

Streit et al.

[11] 4,300,508

[45] Nov. 17, 1981

[54] INSTALLATION FOR OPERATING ELECTROMAGNETIC LOADS IN INTERNAL COMBUSTION ENGINES

[75] Inventors: Klaus Streit, Tübingen; Walter Buxmeyer, Pfullingen; Peter Schülzke, Hemmingen; Klaus Harsch, Ditzingen, all of Fed. Rep. of Germany

[73] Assignee: Robert Bosch GmbH, Stuttgart, Fed. Rep. of Germany

[21] Appl. No.: 67,643

[22] Filed: Aug. 17, 1979

[30] Foreign Application Priority Data

Sep. 26, 1978 [DE] Fed. Rep. of Germany ..... 2841781

[51] Int. Cl.[3] ..... F02D 5/00; H01F 7/18

[52] U.S. Cl. ..... 123/490; 361/154

[58] Field of Search ..... 123/490; 361/154, 153, 361/194

[56] References Cited

U.S. PATENT DOCUMENTS 4,092,717 5/1978 DiNunzio ..... 123/490
4,167,030 9/1979 Heidt ..... 361/154
4,173,031 10/1979 Leichle ..... 361/154
4,176,337 11/1979 Harper ..... 361/154
4,180,026 12/1979 Schulzke et al. ..... 123/490

*Primary Examiner*—Charles J. Myhre
*Assistant Examiner*—Andrew M. Dolinar
*Attorney, Agent, or Firm*—Edwin E. Greigg

[57] ABSTRACT

An installation for the operation of electromagnetic loads, especially solenoid valves, in fuel supply systems in internal combustion engines, wherein a measuring resistor as well as a switch are connected in series with the load and the entire arrangement is connected to the two supply voltage terminals. The installation comprises two comparators connected in parallel with the measuring resistor, at least one resistor being connected in front of these comparators, and controllable current source arranged between the junction of the threshold switch and the resistor in the proximity of the load, as well as a supply voltage terminal. The supply voltage of one of the comparators is made dependent on the voltage in the freewheel circuit, to maintain at least one of the comparators in the operating position even during freewheeling operation.

4 Claims, 2 Drawing Figures b c

INSTALLATION FOR OPERATING ELECTROMAGNETIC LOADS IN INTERNAL COMBUSTION ENGINES

BACKGROUND OF THE INVENTION

The invention is based on an installation for the operation of a solenoid valve in fuel supply systems in internal combustion engines. Such an installation has been known (DOS German Unexamined Laid-Open Application No. 2,612,914), which comprises a measuring resistor connected to the positive pole of the voltage source. However, since this resistor would be destroyed in case of an accidental ground contact of the connection line between resistor and valve, this arrangement is, in most cases, not permissible under practical conditions.

OBJECT AND SUMMARY OF THE INVENTION

The installation of this invention has the advantage over the prior-art arrangement in that upper and lower current threshold values of the current can be separately detected by the measuring resistor and, in particular, the threshold switch for the lower threshold value, i.e. the end of the current flow in freewheel operation, can operate with a floating, i.e. adapted operating voltage.

Advantageous further developments and improvements of the installation may be accomplished with the invention and, by way of example, control of the individual thresholds was found to be especially simple and advantageous.

BRIEF DESCRIPTION OF THE DRAWINGS

One embodiment of the invention is illustrated in the drawings and will be described in greater detail in the following description. In the drawings:

FIGS. 2*a*, 2*b* and 2*c* are pulse diagrams for explaining the installation of FIG. 1.

DESCRIPTION OF THE EMBODIMENT

Figure 1:
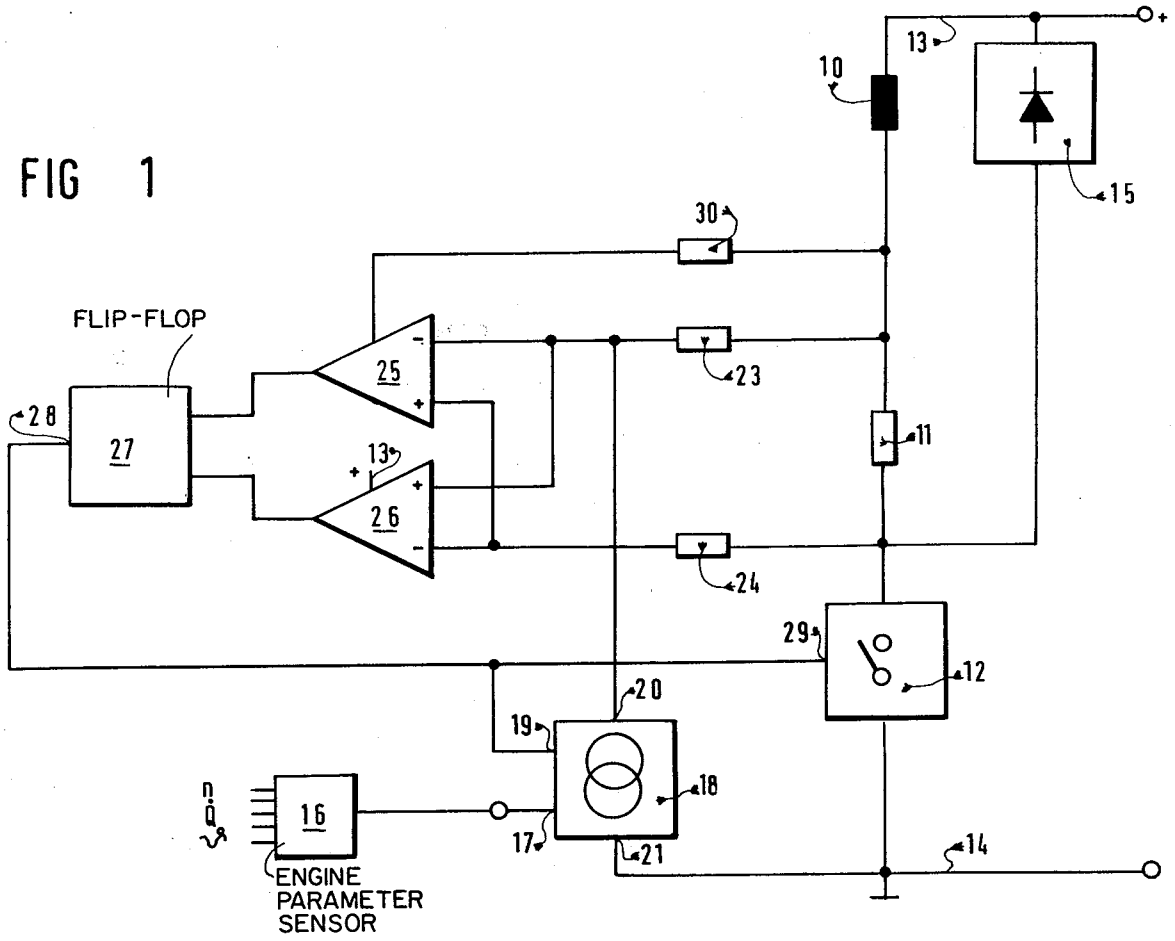
FIG. 1 is a block circuit diagram of an installation according to this invention.

FIG. 1 shows the final stage of a fuel injection system in an internal combustion engine with spark ignition. Reference numeral 10 denotes the magnet winding of an electromagnetic injection valve, a measuring resistor 11, as well as a switch 12 being connected in series therewith. This series circuit is connected between a positive line 13 and a negative or ground line 14. A freewheel control circuit 15 is connected in parallel to the series circuit of valve winding 10 and measuring resistor 11.

Reference numeral 16 denotes a circuit arrangement which is known in the art and generates, starting with various operating parameters, such as, for example, speed n, air feed rate in the intake manifold Q, and temperature Θ, injection signals of a specific duration and passes these signals on to a control input 17 of a controllable current source 18. This controllable current source 18 has a further control input 19, as well as a current input 20 and a current output 21, the current output 21 being connected with ground line 14.

A resistor 23 and a resistor 24 are connected on either side respectively of the measuring resistor 11. These resistors 23 and 24 lead to the inputs of two threshold switches 25 and 26. While resistor 23 is connected to the inverting input of the threshold switch 25 and to the non-inverting input of the threshold switch 26, the resistor 24 is connected to the other inputs of each of the two threshold switches 25 and 26. On the output side, these threshold switches 25 and 26 are connected to a flip flop 27, the output 28 of which is connected, in turn, to the second control input 19 of the controllable current source 18, as well as to a control input 29 of the switch 12. The current input 20 of the controllable current source 18 is connected to the junction of resistor 23 and the threshold switches 25 and 26.

The threshold switch 26 is supplied with voltage from the positive line 13. In contrast thereto, the threshold switch 25 receives its operating voltage via a resistor 30 from the junction of solenoid winding 10 and resistor 11.

Before discussing the mode of operation of the circuit arrangement according to FIG. 1, the desired signal characteristic of the current through the valve winding 10 will be explained with reference to FIG. 2.

Figure 2A:
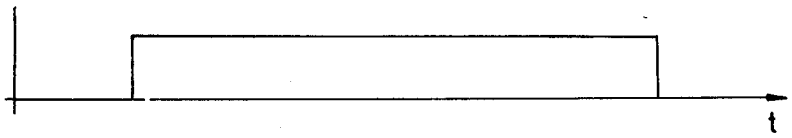

FIGS. 2*a*, 2*b*, and 2*c* illustrate, respectively, plotted over the time, the injection signal, the desired current characteristic through the valve winding of the solenoid valve 10, as well as a representation of the chronological staggering of current threshold values, the switchover of which results in the illustrated current signal through valve winding 10.

It can be seen from FIG. 2*b* that, with a view toward a maximally rapid attraction of the armature of the solenoid valve 10, and thus a rather early initiation of injection, a steep current rise takes place up to such a level that positive attraction and the elimination of chattering motions are ensured. Once the energy has been provided for the opening movement of the solenoid valve 10, then a lower holding current is sufficient for maintaining the solenoid valve 10, in the open position. This holding current is held, by means of a two-position controller, respectively between an upper and a lower current limit value.

In the rest condition of the device of FIG. 1, a zero signal is present at the control input 17 of the controllable current source 18, and the switch 12, series-connected with the valve winding 10 and the measuring resistor 11, is opened. The output signal of the two threshold switches 25 and 26 is likewise zero, and the flip flop 27 likewise shows a zero signal at its output 28.

If a positive signal appears at the control input 17 of the controllable current source 18, then a specific current flows through this current source and through resistor 23 and valve winding 10. This current is very small as compared to the attraction and holding current of the solenoid valve 10, but the corresponding voltage drop at resistor 23 results in a switching of the threshold switch 25, whereby the threshold switch 25 transmits a positive signal at its output and allows the flip-flop 27 to toggle. As a consequence, the switch 12 is closed and the rising current through the measuring resistor 11 produces a growing voltage drop across this resistor. One the voltage drop has attained a certain value, the threshold switch 26 switches over due to its given input polarity, toggles the flip flop 27 back into its original position, and therefore opens switch 12.

The current flowing through solenoid valve 10 and measuring resistor 11 now flows through the freewheel control circuit 15. In accordance with the time constant of the freewheel circuit 15, the current in this circuit 15 fades and once it has reached a lower threshold, the threshold switch 25 again responds, the flip flop 27 is once again toggled, and the switch 12 is again placed into its closed condition, whereby the process described hereinabove is repeated.

The freewheel circuit 15 may consist of a single diode as shown in FIG. 1.

By means of the second control input 19 of the controllable current source 18, the individual threshold values can be controlled.

Figure 2A:
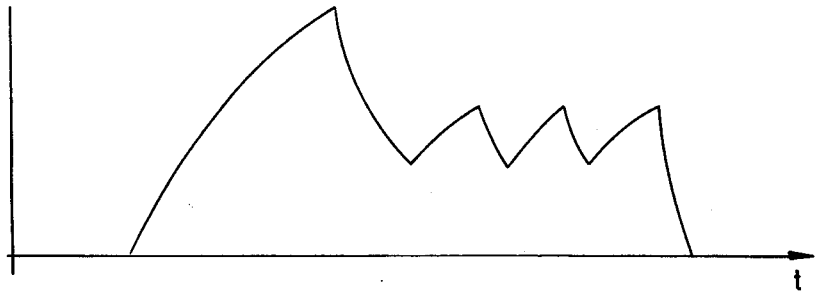
Figure 2A:
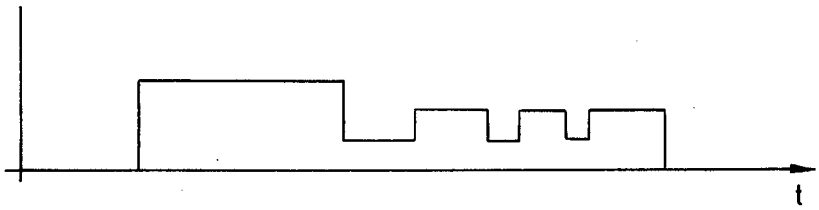

According to FIG. 2*b*, it is desirable, particularly in case of the upper threshold, to be able to set differing maximum current values during the attraction and holding phases. For this reason, the input signals at control inputs 17 and 19 of the controllable current source 18 must be linked as follows:

By way of input 17, a flip flop arranged in current source 18 is set by means of a negative pulse and/or by means of the descending pulse edge at the end of a current flow period (FIG. 2). This flip flop sets the maximum current threshold at a high initial value by way of the signal at input 20. Once the input 17 becomes positive, the current will rise up to this high initial value. Once this value is reached, the minimum current threshold is activated via input 19. At the same time, the aforementioned flip flop is cleared. Thereby, the lower value becomes effective as the maximum current threshold.

The essential aspect in the arrangement of FIG. 1 is that the current source 18 produces at resistor 23 a "floating" reference voltage, i.e., a reference voltage which is independent of the operating voltage. The two threshold switches 25 and 26 together compare this reference voltage with the measuring voltage produced at measuring resistor 11 and proportional to the current through the inductive load 10.

Preferably, the threshold switch 26 is constructed as a differential amplifier with PNP input transistors and thus can be operated with in-phase potentials close to the ground potential. Due to this property, the operation of the threshold switch 26 is impossible with in-phase potentials close to the positive potential.

The resistor 30, which connects the positive supply terminal of the threshold switch 25 to the inductive load, the valve winding 10, and the measuring resistor 11, serves to protect the threshold switch 25 against excessively high currents during overvoltages at the valve winding 10. These overvoltages can intrude, for example, via the positive line 13 from the battery circuit of an automotive vehicle. However, an overvoltage is also produced due to self-induction after switching off of switch 12, namely when the freewheel circuit 15 becomes active and thus a voltage occurs at the measuring resistor 11 which is increased to the extent that the voltage drops across the freewheel circuit 15 (for example diode voltage).

To ensure that the threshold switch 25 operates correctly also during these operating phases, its operating voltage terminal is connected to the junction of the magnet winding 10 and measuring resistor 11, so that the supply potential of the threshold switch 25 is likewise "floating", i.e., even with the switch 12 being open, it is higher than the highest potential at one of its inputs.

Also the resistor 23 fulfills a protective function for the inputs of the threshold switches 25 and 26. The same holds true for resistor 24 which actually is dispensable for the function. Moreover, however, the resistor 24 can be utilized to compensate for the voltage drop at resistor 23 due to input currents from threshold switches 25 and 26, wherein the same values are chosen for the two resistors 23 and 24.

The flip flop 15 can basically be replaced by a NOR circuit, but the latter has dynamically poorer properties.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An installation for the operation of electromagnetic loads, especially solenoid valves, in the fuel supply systems of internal combustion engines having supply voltage lines, including:

a switch;

a switching element;

first and second threshold switches connected to control the switching element;

a resistor wherein each end of the resistor is connected to an input of each of the first and second threshold switches to regulate the first and second threshold switches, and;

wherein said electromagnetic load, the switch and the resistor are connected in series between the supply voltage lines;

at least one further resistor connected to at least one input of the first and second threshold switches to regulate said at least one input; and a controllable current source connected at one end between a junction of the first threshold switch and the at least one further resistor and connected at a second end to one of the supply voltage lines.

2. An installation according to claim 1, including an additional resistor; wherein said resistor is connected in a junction with said electromagnetic load and wherein said first threshold switch includes a supply voltage terminal and wherein said supply voltage terminal of said first threshold switch is connected via said additional resistor to the junction of said resistor and said electromagnetic load.

3. An installation according to claim 1, wherein said electromagnetic load comprises a solenoid valve having an armature and said installation includes means wherein said current source, when a solenoid valve is operated as said load, can be controlled in dependence on the attraction and holding phases of the armature of said solenoid valve.

4. A method of operating a solenoid injection valve having a winding in the fuel supply system of an internal combustion engine comprising the steps of:

connecting a series circuit including a normally open switch, a resistor and said valve winding to a source of electrical power, feeding a current from a controllable current source responsive to engine operating parameters through a further resistor and said valve winding, toggling a flip/flop from an original position with an output signal from a first threshold switch responsive to the voltage drop across said further resistor, transmitting an output signal from said flipflop to said switch to close said switch and thereby increase the voltage drop across said resistor, toggling said flip/flop to its original position with an output signal from a second threshold switch at a predetermined voltage drop across said resistor, applying the current flowing through said valve winding and said resistor to a free wheel control circuit, toggling said flip/flop with the output signal from said first threshold switch at a predetermined threshold current value in said freewheel control circuit, and transmitting the output signal from said flip/flop to said switch to close said switch.

* * * * *